US009077114B2

(12) United States Patent
Oh et al.

(10) Patent No.: US 9,077,114 B2
(45) Date of Patent: Jul. 7, 2015

(54) QUICK CONNECT POWER CONNECTOR

(71) Applicant: Tyco Electronics Corporation, Berwyn, PA (US)

(72) Inventors: Lawrence Se-Jun Oh, Hummelstown, PA (US); John Louis McKibben, Dallastown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/336,417

(22) Filed: Jul. 21, 2014

(65) Prior Publication Data

US 2015/0031225 A1 Jan. 29, 2015

Related U.S. Application Data

(63) Continuation of application No. 13/948,866, filed on Jul. 23, 2013.

(60) Provisional application No. 61/857,532, filed on Jul. 23, 2013.

(51) Int. Cl.

| | |
|---|---|
| ***H01R 13/625*** | (2006.01) |
| ***H01R 13/641*** | (2006.01) |
| ***H01R 11/28*** | (2006.01) |

(Continued)

(52) U.S. Cl.

CPC ..... *H01R 13/641* (2013.01); *H01R 11/282* (2013.01); *H01R 11/285* (2013.01); *H01R 4/48* (2013.01); *H01R 13/6275* (2013.01); *H01R 13/6271* (2013.01); *H01R 13/639* (2013.01)

(58) Field of Classification Search

USPC ..... 439/347, 680

See application file for complete search history.

(56) References Cited

U.S. PATENT DOCUMENTS 4,590,540 A * 5/1986 Nicholson et al. ..... 439/347
5,013,258 A * 5/1991 Schaef ..... 439/347

(Continued)

FOREIGN PATENT DOCUMENTS

EP 0 093 628 A2 11/1983
EP 1439610 A2 7/2004

(Continued)

OTHER PUBLICATIONS

TE Connectivity Manual, "Quick Bar Reference Guide Bus Bar Connectivity", te.com/products/busbar, 6 pgs., Apr. 2013.

(Continued)

*Primary Examiner* — Tho D Ta

(57) ABSTRACT

An electrical connector for connecting to a terminal post. The electrical connector includes a housing body, a contact and a locking release member. The housing body includes a post receiving passage for receiving the terminal post therein. The contact is provided in the post receiving passage and is positioned about the circumference of the post receiving passage. The contact will make an electrical engagement with a terminal post inserted into the post receiving passage regardless of the orientation of the terminal post with respect to the contact. The locking release member is moveably mounted to the housing body and is moveable between a first position and a second position. The locking release member cooperates with a locking spring member. The locking spring member has a locking section which cooperates with a recess of the terminal post when the locking release member is in the first position.

20 Claims, 4 Drawing Sheets

(51) Int. Cl.

| | |
|---|---|
| ***H01R 4/48*** | (2006.01) |
| ***H01R 13/627*** | (2006.01) |
| ***H01R 13/639*** | (2006.01) |

(56) References Cited

U.S. PATENT DOCUMENTS

| | | | | |
|---|---|---|---|---|
| 5,435,742 | A * | 7/1995 | Cecil, Jr. | 439/347 |
| 5,823,813 | A * | 10/1998 | Dye | 439/347 |
| 5,954,520 | A * | 9/1999 | Schmidt | 439/680 |
| 6,183,904 | B1 | 2/2001 | Kuboshima et al. | |
| 6,302,720 | B1 * | 10/2001 | Muller | 439/347 |

FOREIGN PATENT DOCUMENTS

| | | | |
|---|---|---|---|
| EP | 1737082 | A2 | 12/2006 |
| FR | 2 941 819 | A1 | 8/2010 |
| WO | 2013/052571 | A1 | 4/2013 |

OTHER PUBLICATIONS

Tyco Electronics Power Connectors & Interconnection Systems, Cable Mounted Products, "Rapid Lock Quick Connect/Disconnect Bus Bar Connectors", pp. 164-167, www.tycoelectronics.com, Feb. 2010.

* cited by examiner

QUICK CONNECT POWER CONNECTOR

CROSS-REFERENCE TO RELATED APPLICATION

This application claims priority to U.S. application Ser. No. 13/948,866 filed Jul. 23, 2013, entitled "Quick Connect Power Connector" and to U.S. Provisional Application No. 61/857,532 filed Jul. 23, 2013, entitled "Quick Connect Power Connector Isolating System", both of which are hereby incorporated by reference in their entirety.

FIELD OF THE INVENTION

The present invention is directed to an electrical connector which provides a quick, simple and reliable connection to mating posts. In particular, the invention is directed to an electrical connector which prevents the improper mating of the connector to the post and provides a visual indication that the proper connection is secured.

BACKGROUND OF THE INVENTION

Electrical connectors for military, aviation, vehicular and other applications which required power must be able to withstand the environmental conditions, such as high vibrations, to which such connectors are subjected. The connectors also must provide high quality electrical connection through very broad ranges of temperature variations. Additionally, electrical connectors that are disposed in engine compartments and the like must protect against the inadvertent but inevitable manual contact that occurs as a mechanic tries to access a nearby component disposed in the crowded compartment. In many instances these electrical connectors must also accommodate extremely high amperage.

Such electrical connectors which are found in the prior art typically include a threaded stud terminal to which a threaded nut may be selectively connected. A typical prior art terminal for connection to such threaded stud terminal includes a mating end effectively defining a generally planar eyelet that is dimensioned to be slidably passed over the threaded stud terminal. The opposed end of such a terminal typically will be crimped and/or soldered to a conductor of the wire. The eyelet is maintained in a mated condition on the threaded stud terminal by the nut which is threaded tightly against the planar portion of the eyelet for securely retaining the terminal on the threaded stud terminal and for providing the high contact forces that are desired.

Such typical prior art electrical connector perform well under routine environmental conditions. However, the threaded components of these prior art connectors are fairly expensive to manufacture. Furthermore, the threaded interconnection adds significantly to assembly time and costs and can make disassembly for periodic repair and maintenance difficult, particularly as torque wrenches are required to properly seat the hardware. A number of parts are required to perfect the electrical connection, thereby also adding to the cost of the connection and creating the possibility of foreign object debris (FOD) which could damage engines and the like. Also, as the connectors are exposed to vibration and the like, the nuts may rotate off of the threaded component, which can lead to a failed, open electrical connection. In addition, any attempt to provide environmental sealing for such an electrical connection will generally require an entirely separate protection means that is functionally and structurally unrelated to the threaded interconnection to the alternator.

Many prior art electrical connectors rely upon resiliency of the metal to achieve electrical connection. However, it is extremely difficult to achieve the high contact forces with an electrical connector that must also ensure a large surface contact area and a large cross sectional area of metal to effect a reliable electrical connection. Other prior art electrical connectors have included spring means which are intended to achieve secure electrical connection without resorting to combinations of threads and nuts. Still other connectors have included a stamped member having a pair of deflectable arms with apertures extending therethrough. The arms can be biased such that the apertures align with one another to permit insertion of a pin through the aligned apertures. However, when the biasing force on the arms is released, the arms resiliently return to a condition where they bind against the pin inserted through the apertures. The prior art further includes the use of clips which perform no direct electrical connection function, but which securely retain the housings of two electrical connectors together.

In applications which do not use threaded components or the like, simple insertion of the connector onto terminal posts does not assure that the connectors are properly positioned and locked in place. In order to be sure that the components are properly connected and electrically engaged, a latch assembly/position assurance member is provided. Often, an audible click is typically used to detect if the connector is fully mated, however, background noise can make this ineffective.

However, even with these position assurance members, a number of connectors and terminals are not fully mated, causing system failures. This is due to the fact that some connectors and terminals are mated far enough to make initial, electrical contact but the latches of the position assurance members are not fully engaged causing the connector to not be locked or secured on the terminal. These connectors later come apart in the field, e.g. as a vehicle is driven on bumpy roads etc., causing loss of system function. Therefore, incorporating position assurance members into the connectors does not guarantee that the connectors will be properly mated and secured, as in many instances the operator does not properly activate the position assurance member.

It would be beneficial to have connectors which overcome the problems identified above and which allow for quick connection without the use of tools and which provide for a visual means to assure that the connectors are properly mated.

SUMMARY OF THE INVENTION

In view of the above, it is an object of the subject invention to provide a connector which provides a quick, simple and reliable connection to mating connectors or posts and to the power bus to which the posts are connected.

It is another object of the subject invention to provide a high amperage electrical connector that enables quick connection and disconnection.

It is another object of the subject invention to provide a connector with a locking member to maintain the connector in position on the post or mating contact.

It is another object of the subject invention to provide a connector with a visual indication which provides a quick and cost effective means to confirm that the connection is secured.

It is another object of the subject invention to provide a one piece connector, thereby eliminating loose components which can fall during installation or which can come loose during operation.

It is another object of the subject invention to provide a connector which requires no tooling to install.

It is another object of the subject invention to provide a connector which can be inserted onto a post from any direction, thereby allowing the connector be terminated to the post regardless of orientation.

It is another object of the subject invention to provide a connector in which the electrical connection to the post will remain secure regardless of vibration or other environmental conditions.

An embodiment is directed to an electrical connector for connecting to a terminal post. The electrical connector includes a housing body, a contact and a locking release member. The housing body includes a post receiving passage for receiving the terminal post therein. The contact is provided in the post receiving passage and is positioned about the circumference of the post receiving passage. The contact will make an electrical engagement with a terminal post inserted into the post receiving passage regardless of the orientation of the terminal post with respect to the contact. The locking release member is moveably mounted to the housing body and is moveable between a first position and a second position. The locking release member cooperates with a locking spring member. The locking spring member has a locking section which cooperates with a recess of the terminal post when the locking release member is in the first position. A keying member receiving recess is provided in the housing proximate the post receiving passage, the keying member receiving recess is configured to cooperate with a keying member positioned on the post to ensure proper mating of the connector to the post.

An embodiment is also directed to an electrical connector system. The electrical connector system includes an electrical connector, a post and a keying member. The electrical connector includes a housing body with a post receiving passage for receiving the terminal post therein. The housing body has a stop surface provided thereon. A contact is provided in the post receiving passage. The contact is provided in electrical engagement with the terminal post inserted into the post receiving passage regardless of the orientation of the contact with respect to the terminal post. A locking slide is moveably mounted to the housing body, such that the locking slide is moveable between a prelocked position and a locked position. A locking latch is securely maintained in the locking slide. The locking latch cooperates with the stop surface to prevent the movement of the locking slide to the locked position if the electrical connector is not properly mated to the terminal post. The locking latch has a radiused locking surface which cooperates with a recess of the terminal post when the locking slide is in the locked position.

An embodiment is also directed to an electrical connector for connecting to a terminal post. The electrical connector includes a housing body, a contact and a locking release member. The housing body includes a post receiving passage for receiving the terminal post therein. The contact is provided in the post receiving passage and is positioned about the circumference of the post receiving passage. The contact will make an electrical engagement with a terminal post inserted into the post receiving passage regardless of the orientation of the terminal post with respect to the contact. The locking release member is moveably mounted to the housing body and is moveable between a first position and a second position. The locking release member cooperates with a locking spring member. The locking spring member has a locking section which cooperates with a recess of the terminal post when the locking release member is in the first position.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
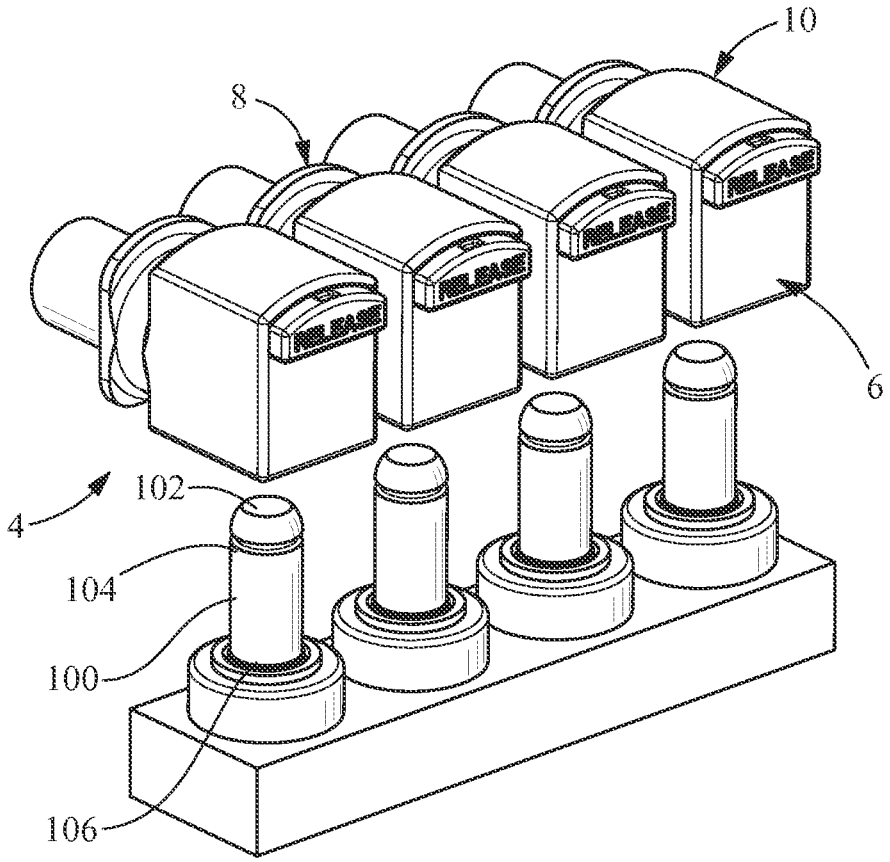
FIG. 1 is a perspective view of an illustrative embodiment of four quick connect power connectors according to the present invention shown prior to mounting to mating connectors or posts, the mating posts having keying members positioned thereon.
Figure 2:
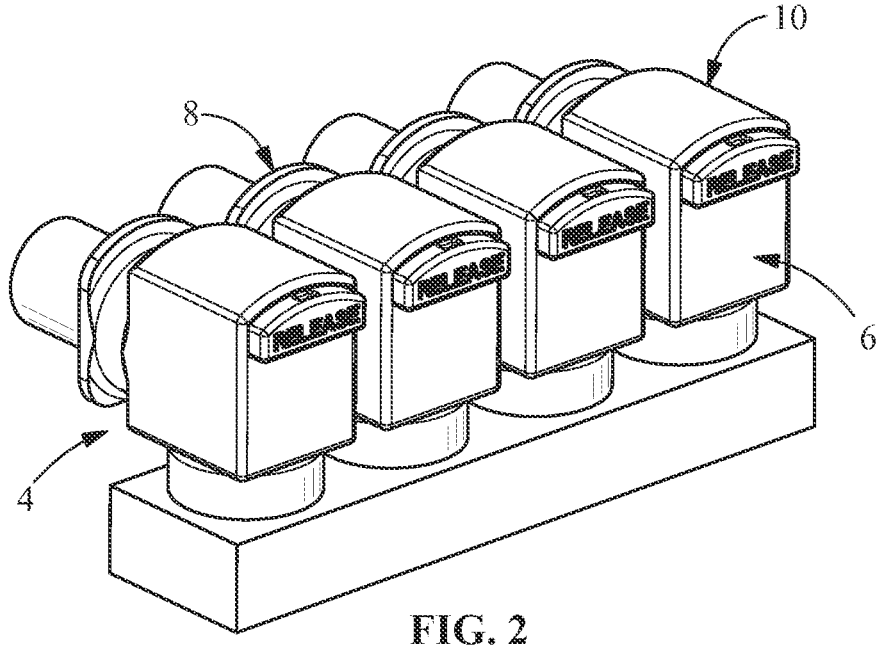
FIG. 2 is a perspective view of the four quick connect power connectors of FIG. 1 fully mated to the mating posts.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

FIG. 1 shows a perspective view of four electrical connectors or plugs 4, 6, 8, 10 prior to insertion on male posts or mating pins 100, 101, 103, 105. FIG. 15 illustrates the connectors 4, 6, 8, 10 fully mated to the posts 100, 101, 103, 105. The electrical connectors 4, 6, 8, 10 and posts 100 are shown as illustrative representations. The particular configuration of the connectors 4, 6, 8, 10 and posts 100, 101, 103, 105 may vary without departing from the scope of the invention. While four connectors 4, 6, 8, 10 are shown, any number of connectors can be used without departing from the scope of the invention. As will be more fully described below, the connectors 4, 6, 8, 10 and the posts 100, 101, 103, 105 are configured and are rated to carry different electrical loads.

Figure 3:
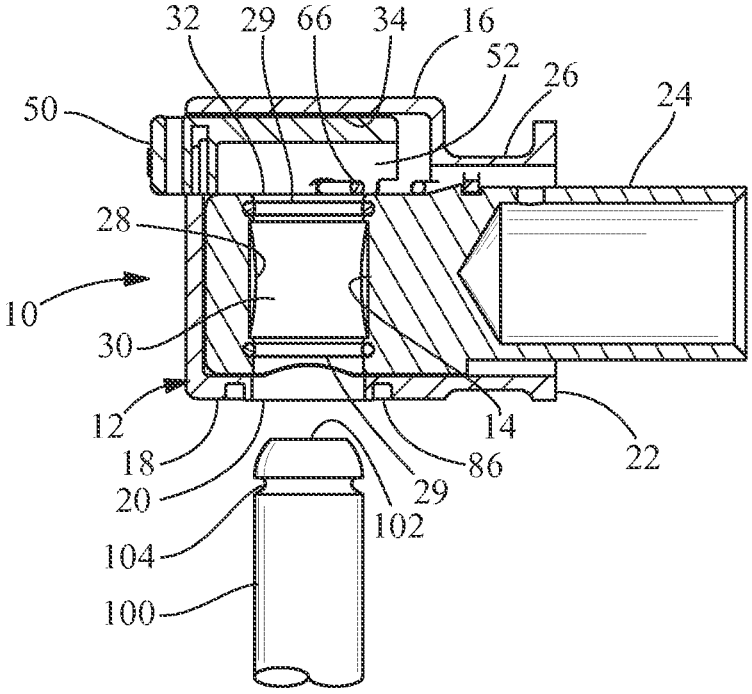
FIG. 3 is a cross-sectional view of one quick connect power connector of FIG. 1 in alignment with a mating post, illustrating the quick connect power connector prior to the mating post engaging a locking member.
Figure 4:
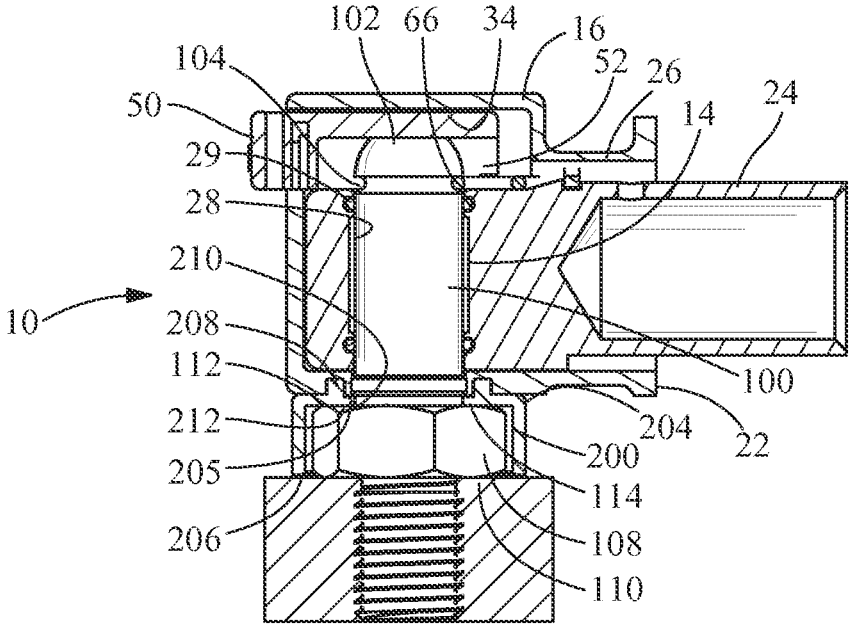
FIG. 4 is a cross-sectional view of the quick connect power connector of FIG. 3, illustrating the quick connect power connector in the latched or locked position.

As connectors 4, 6, 8, 10 have many similar components, for ease of description and understanding, only one connector 10 will be described in detail. However, connectors 4, 6, 8 have similar components to those described herein. Referring to FIGS. 3 through 7, each electrical connector 10 has a housing body 12 with a post receiving passage 14 for receiving a respective post 100 therein. As best shown in FIGS. 3 and 4, each electrical connector 10 has a first or top end 16 and an oppositely facing second or bottom end 18 which has an opening 20 to receive the post 100 therethrough. The opening 20 extends to the post receiving passage 14. A conductor or wire receiving sidewall 22 extends between the first end 16 and the post receiving end 18. A conductor or wire (not shown), is inserted into a conductive wire receiving member 24 which extends from the sidewall 322 and is terminated thereto by crimping or other known termination methods. An insulation receiving recess 26 extends circumferentially around the conductive wire receiving member 24. The insulation receiving recess 26 allows an insulator, such as, but not limited to, a boot, to be installed over the conductive wire receiving member 26, thereby insulating the conductive wire receiving member 24 from other components and the operator. In the embodiment shown, the conductive wire receiving member 24 is a separate member made from conductive material.

A contact 28 (FIGS. 3 and 4) is positioned in the post receiving passage 14. In the embodiment shown, the contact 28 is a band which extends around the circumference of the passage 14. The band has resilient contact arms which extend into the passage 14 (as best shown in FIG. 3). As the post 100 is inserted into the passage 14, the contact arms 30 are resilient deformed and are placed in electrical contact with the post 100. The contact 28 is positioned in the passage 14 such that the contact 28 will be placed in electrical engagement/contact with the post 100 regardless of the orientation of the contact 28 with respect to the post 100. This allows the wire receiving member 24 to be oriented at any position about the circumference of the post 100. The conductor and wire provided in the wire receiving passage 26 are electrically connected to the contact 28 using known methods of termination. While the contact 28 is shown in the form of a band, other types of contacts can be used without departing from the scope of the invention, such as, but not limited to the contact element described in co-pending U.S. patent application Ser. No. 14/336,356, filed contemporaneously herewith, which is hereby incorporated by reference in its entirety. Sealing members 29 are provided above and below (as viewed in FIGS. 3 and 4) contact 28. The sealing members 29 prevent moisture or other types of contaminants from effecting the electrical connection between the contact 28 and the post 100 when the connector 10 is inserted on the post 100. In the embodiment shown, the sealing members 29 are O-rings made of rubber. However, other types of sealing member and other materials may be used without departing from the scope of the invention.

A terminal post receiving opening 32 extends through or is provided proximate to the first or top end 16 of the body 12 of the connector 10. The opening 32 is positioned in alignment with post receiving passage 14. The opening 32 is dimensioned to receive a free or top end 102 of the post 100 therein.

A locking release cavity 34 (as best shown in FIGS. 3, 4, 6, 7) is provided proximate end 16. The locking release cavity 34 extends across opening 32 and, in the embodiment shown, extends essentially the entire width of the connector 10.

A locking release member 50 is positioned in the cavity 34. The locking release member 50 is slidably mounted in the cavity 34 of connector body 12. The locking release member 50 has a recess or cavity 52 which receives the top end 102 of the post 100 therein. The recess 52 is dimensioned to be larger than the top end 102 of the post 100 to allow the locking release member 50 to move relative to the top end 102 of the post 100, as will be more fully described.

Figure 5:
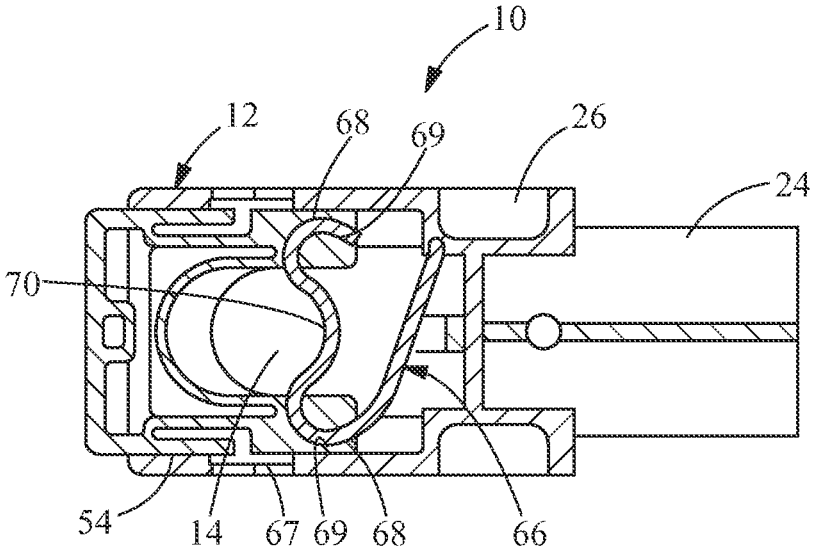
FIG. 5 is a cross-sectional view of one quick connect power connector of FIG. 1 taken along line 5-5, illustrating the locking member in a first position.
Figure 6:
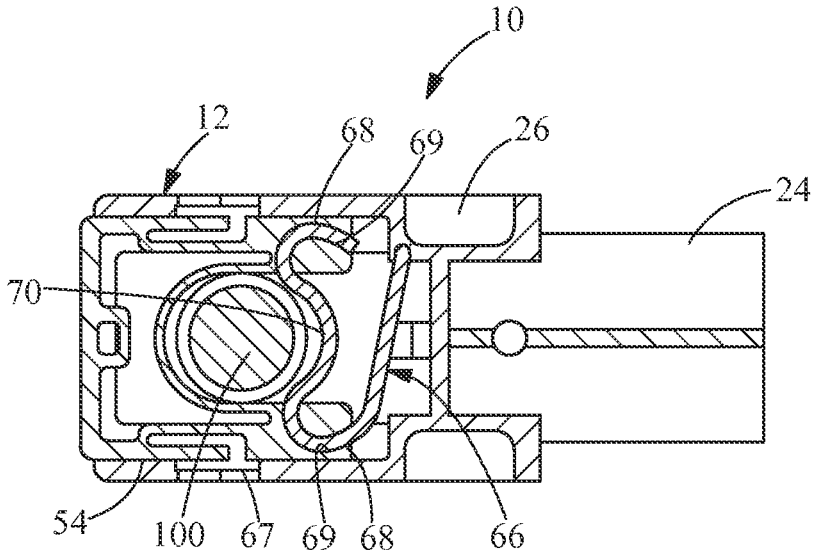
FIG. 6 is a cross-sectional view of a quick connect power similar to that of FIG. 5, illustrating the locking member in a second position.
Figure 7:
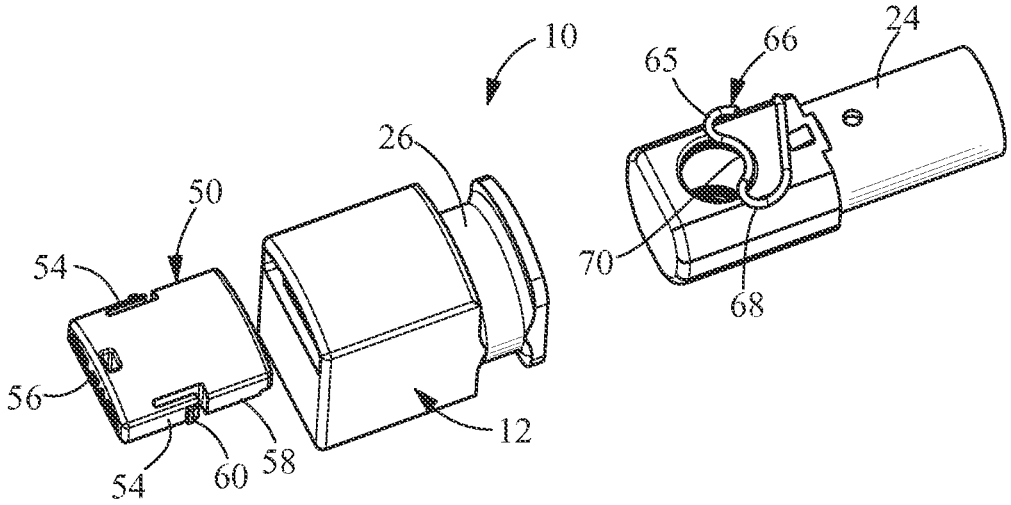
FIG. 7 is an exploded perspective view of one quick connect power connector of FIG. 1, illustrating the locking member in a first position.
Figure 8:
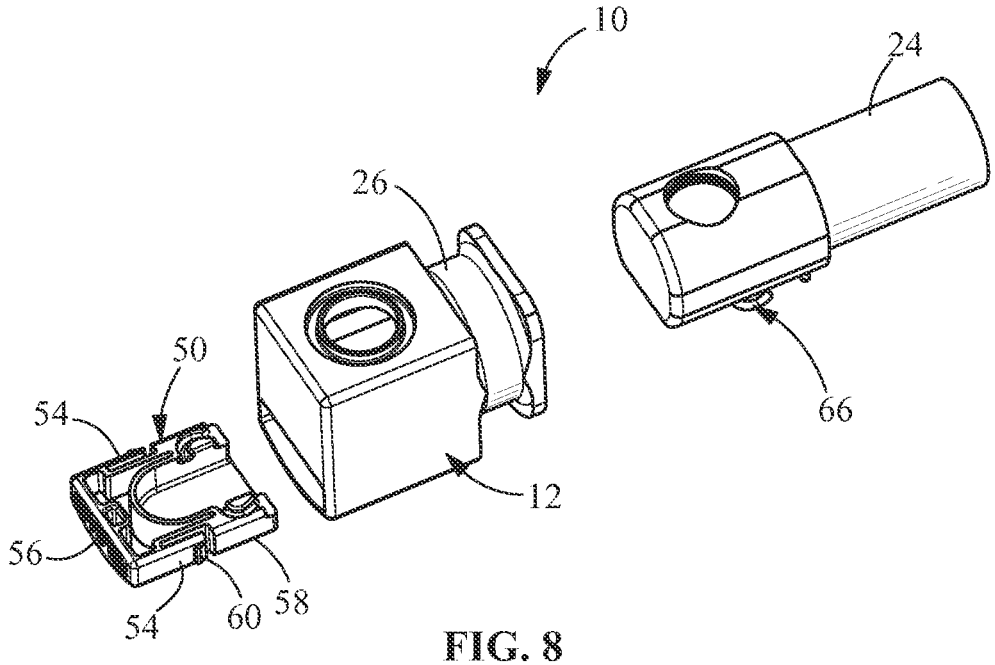
FIG. 8 is a bottom exploded perspective view of the quick connect power connector of FIG. 7.

Latching arms 54 (as best shown in FIGS. 7 and 8) extend from an engagement surface 56 of locking release member 50 proximate side surfaces 58. The latching arms 54 are provided on either side of locking release member 50. Each latching arm 54 has a projection 60 which is dimensioned to be received in an opening 61 of the body 12 of the connector 10, as best shown in FIGS. 5 and 6. The projections 60 are movable in the openings 61 between a first position and a second position, as will be more fully described.

A locking spring member 66 is housed in the cavity 34 and cooperates with the release member 50. The locking spring member 66 may be retained in the cavity 34 by known securing techniques, such as by placement of a mounting portion of the spring 66 in a mounting opening or cavity of the body 12 of the connector 10. The locking spring member 66 is also retained to the locking release member 50, whereby the locking spring member 66 moves together with the locking release member 50. As best shown in FIG. 6, the locking spring member 66 has a pair of mounting sections 68 which are positioned in recess 69 of the locking release member 50. Extending between the sections 68 is a locking section 70 which has a radiused locking surface which cooperates with the post 100, as will be more fully described.

When the electrical connector 10 is mated with the mating post 100, the post 100 is received within the post receiving passage 14 of the electrical connector 10, as best shown if FIG. 4.

FIG. 3 shows a cross-sectional view of the electrical connector 10 as the electrical connector 10 is being mated with the post 100. This view illustrates the post 100 positioned in the post receiving passage 14 prior to engaging the locking spring member 66. The locking spring member 66 and the locking release member 50 are shown a first or pre-stressed position. In this position, the locking spring member 66 is in a first position. In this position, the spring 66 is partially or slightly deflected, causing the locking release member 50 to be biased toward the first position, as shown in FIG. 5. In this position, projections 60 engage walls of openings 61, thereby preventing the removal of the locking release member 50 from the cavity 34. This provides the operator with a visual indication that the locking release member 50 is in the first position. In this first position, the radiused locking section 70 extends into the space defined by the longitudinal extension of the side wall of the opening 14.

As insertion of the post 100 into the post receiving passage 14 continues, the top end 102 of post 100 moves through opening 32 and engages locking section 70, as best shown in FIG. 6, causing the locking spring member 66 to be resiliently deformed, allowing the top surface 102 of the post 100 to move beyond the locking section 70 of the spring 66. This movement is controlled and limited by the cooperation of the engagement of the projections 60 with the sidewalls of openings 61.

As the spring 66 is deformed, the locking release member 50 and the spring 66 are moved from the first position (FIG. 5) to the second or transition position (FIG. 6). With the pin 100 fully inserted, the spring 66 is returned toward the first position. However, if the connector 10 is not properly mated with the post 100, the locking release member 50 will not be allowed be returned to or toward the first position, as will be described.

As the locking release member 50 is moved from the first position of FIG. 5 to the transition position of FIG. 6, the locking section 70 is moved out of opening 14. As movement of the post 100 continues, the locking section 70 is aligned with a locking surface receiving recess 104 of post 100, allowing the spring 66 to resiliently return toward the first position, moving the locking section 70 in the recess 104 to secure the connector 10 to the post 100. In the embodiment shown, the recess 104 extends circumferentially about the surface of the post 100 proximate end 102. As the recess 104 extends about the entire circumference of the post 100, the locking section 70 can engage the recess 104 of the post 100 regardless of the orientation of the connector 10 with respect to the post 100. This allows the wire receiving member 24 to be oriented at any position about the circumference of the post 100. With the post 100 properly inserted into the connector 10, the locking surface 72 is moved into the recess 104 which allows the locking spring member 66 and the locking release member 50 to be moved to the fully locked position, as shown in FIG. 4. However, if the post 100 is not fully inserted, the locking surface 72 will not be aligned with the recess 104. Consequently, the locking spring member 66 and the locking release member 50 cannot be returned to or toward the first or locked position, thereby providing a visual indication that the connector 10 is not properly inserted onto the post 100.

The resiliency of spring 66 prevents the unwanted movement of the locking spring member 66 and the locking release member 50 back toward the transition or open position. Consequently, as the locking release member 50 and locking spring member 66 are retained in the closed or locked position, environmental conditions, such as, but not limited to, vibration, do not result in the inadvertent or unwanted electrical disengagement of the connector 10 from the post 100. This ensures that a positive electrical connection will be maintained.

If the connector 10 is to be disengaged from the post 100, the operator presses the locking release member 50 inward, causing the locking release member 50 to move the locking spring member 66 to the transition or open position. This moves the locking section 70 out of the recess 104, allowing the connector 10 to be removed from the post 100.

The connector system and method described herein provides a simple and reliable connector to mating posts and to the power bus to which the posts are connected. The connector is inserted onto the post making an electrical connection thereon. The use of the locking slide ensures that the connector is fully inserted onto the post, thereby ensuring that a positive electrical connection is provided and maintained. The visual indication provides a quick and cost effective means to confirm that the connection is secured.

The connector 10 and release member 50 are retained together and act as one piece. Consequently, there are no loose components which can fall during installation or which can come loose during operation. Therefore, potential damage to the equipment from foreign object debris is greatly reduced. In addition, as the connectors required no tooling to install, the installation of the connectors is greatly simplified.

The one piece connector according to the present invention performs all of the functions of the prior art multi component connectors. The one piece design results in a significant cost advantage over the prior art connectors.

The configuration of the connector 10, the contact 28 and the locking spring 66 allow for the connector to be inserted onto the post 100 from any direction. In many circumstances, it is difficult to manipulate and twist the wire connected to the contact 28 through the wire receiving member 24. Often because of lack of space or the inflexibility of the wire, it is important that the connector 10 be able to be terminated to the post regardless of the orientation of the wire relative to the post. As the contact 28 and locking spring 66 are operable no matter the orientation relative to the post, the present invention allows the termination of the wire to the post without damage to the wire or the post.

The use of the locking release member 50 and locking spring 66 allows the connector 10 to remain in electrical engagement with the post 100, 100 regardless of the environmental conditions to which the connector and system are exposed. For example, vibration applied to either the post or the connector will not cause the failure of the electrical connection there between.

While the quick connect and disconnect connector can be used for many application, the configuration allows for use with high amperage electrical connections which require up to 1000 amps per contact.

The body 12 of the connector 10 and the locking release member 50 are made from plastic or other material having nonconductive properties. Consequently, the connector 10 and the release member 50 may be engaged by the operator/user.

The posts 100 and connectors 10 can be used for power or ground connections. In addition, the posts 100 and connectors 10 can be used to carry different amperage and/or different voltage. It is, therefore, essential that only connectors with similar electrical properties/characteristics be allowed to mate with respective posts. By limiting the mating capabilities between respective connectors 10 and posts 100, a proper, optimum, reliable and safe electrical connection is ensured.

Referring to FIGS. 1 through 4, keying member 200 may be provided to ensure proper connection between respective connectors and posts. While connectors 4, 6, 8, 10 are shown, connectors 4, 6, 8, 10 are an illustrative embodiment and the claims are not intended to be limited to the embodiment of the connector shown and described. Another embodiment of such a connector system is shown in co-pending U.S. Provisional Patent Application Ser. No. 61/857,532 filed on Jul. 23, 2013, which is hereby incorporate by reference in its entirety.

As best shown in FIG. 3, each connector 4, 6, 8, 10 has a keying receiving relief or recess 86 which extends from the second or bottom end 18 of the body 12 of the connector 4, 6, 8, 10 toward the first or top end 16 of the body 12. In the embodiment shown, the keying receiving recess 86 is positioned proximate the post receiving passage 14 and extends about the circumference of the post receiving passage 14. The spacing of the receiving recess 86 from the post receiving passage 14 may vary, as will be further described below. Other embodiments of the keying receiving recess 84 may be used without departing from the scope of the invention.

Post 100 includes a bus mating end 106 which is positioned away from the top end 102. In the embodiment shown, a hex nut 108 is provided proximate the bus mating end 106 and extends about the circumference of the bus mating end 106. As best shown in FIG. 3, the nut 108 has a first surface 110 and an oppositely facing second surface 112. The first surface 110 cooperates with a substrate, circuit board, bus bar or other such component to properly seat the post 100. However, other configuration can be used without departing from the scope of the invention. A retaining recess 114 extends about the circumference of the mating end 106. The retaining recess 114 is spaced from the nut 108 in a direction toward the top end 102.

Plastic, insulative or isolating keying members 200 are positioned on posts 100. In FIG. 1, different keying members 200 are shown. Keying members 200 are representative embodiments which cooperate with connectors 4, 6, 8, 10 to ensure that only connectors with desired electrical properties/characteristics can be mated with respective posts with similar electrical properties/characteristics, as will be more fully described.

As best shown in FIGS. 3 and 4, keying members 200 have first ends 204 and second ends 206. The first ends 204 have recesses 205 which are dimensioned to cooperate with the second surfaces the nuts 108 when the keying members 200 are fully inserted onto posts 100. Keying projections 208 extend from the second ends 206 in a direction away from the first ends 204. An opening 210 is provided in each keying member 200. The openings 210 extend through the keying members 200 and the keying projections 208 to allow the posts 100 to be inserted therethrough. The keying projections 208 extend about, but are spaced from, the circumference of openings 210 at varying distances. Retaining members 212 are provided proximate the openings 210 to cooperate with recesses 114 of posts 100 to retain the keying members 200 one the posts 100.

In use, the connector system uses the keying members 200 to ensure that only connectors with desired electrical properties/characteristics can be mated with respective posts with similar electrical properties/characteristics, thereby ensuring that a safe and effective electrical connection between the connectors and the posts is affected.

The keying member 200 is inserted onto the post 100 prior to respective electrical connectors 4, 6, 8, 10 being mated to the post. The opening 210 accepts the post 100 therein and allows the keying member 200 to be inserted onto the post 100 toward the nut 108 of the post 100. As this occurs, the retaining member 212 of the keying member 200 is resiliently deformed. Insertion continues until the retaining member 212 engages the recess 114 of the post 100. As this occurs, the retaining member 212 move toward an unstressed position, securing the retaining member 212 in the retaining recess 114 and thereby securing the keying member 200 to the post 100.

With the keying member 200 maintained on the post 100, a respective electrical connector 4, 6, 8, 10 is inserted onto the post 100. As this occurs, the post 100 is received in the post receiving passage 14. If the respective connector 4, 6, 8, 10 has the appropriate electrical characteristics/properties which correspond to the electrical characteristics/properties of the respective post 100, the keying projection 208 of the keying member 200 will align with the projection receiving recess 86 of the connector, allowing the connector to be fully mated with the post 100, as was previously described.

Alternatively, if the respective connector does not have the appropriate electrical characteristics/properties properties which correspond to the electrical characteristics/properties of the respective post 100, the keying projection 208 of the keying member 200 will not align with the projection receiving recess 86 of the connector, thereby preventing the connector from being fully mated with the post 100. This prevents the respective connector from being improperly inserted onto a post 100 with differing electrical characteristics/properties.

Many different configurations of the projection receiving recesses 86 and the keying projections 208 can be provided to accommodate for many different keying combinations. In order to provide for different combination, the projection receiving recesses 86 and the keying projections 208 may have, but are not limited to, different spacing, different shapes/configurations and/or different colors. In addition, multiple, and/or different numbers projection receiving recesses 86 and keying projections 208 may be provided to facilitate further combinations.

The method of positioning a connector on a post, as described in the description above, includes: inserting a keying member onto the post; retaining the keying member on the post; inserting the connector onto the post; engaging the keying member with the connector; and properly seating the connector on the post if keying member properly mates with a keying receiving recess of the connector. The keying member ensures that only a connector with desired electrical characteristics is mated to a post with similar electrical characteristics ensuring that a proper, reliable and safe electrical connection is provided.

Prior to inserting the keying member onto the post, the colors of the locking release button 50 (or other parts of the connector) and the color coded keying projections 208 may be visually checked to make certain that they match, thereby ensuring that only proper connectors are inserted on proper posts 100. With the colors properly matched, the respective keying projection 208 can be properly and fully positioned in a corresponding respective receiving recess 86, thereby ensuring that only proper respective connectors are mated on proper respective posts 100.

The connector, system and method described herein provides a simple and reliable connection to mating posts and to the power bus to which the posts are connected. The connector is inserted onto the post making an electrical connection thereon. The use of the keying member ensures that only connectors with desired electrical characteristics are mated to posts with similar electrical characteristics ensuring that a proper, optimum, reliable and safe electrical connection is ensured.

If the keying projection 208 and the projection receiving recess 86 of the connector 4, 6, 8, 10 properly align or mate and the connector 4, 6, 8, 10 is properly inserted onto the post 100, the use of the locking release member 50 ensures that the connector is fully inserted onto the post, thereby ensuring that a positive electrical connection is provided and maintained. The visual indication provides a quick and cost effective means to confirm that the connection is secured.

The configuration of the connector, the post and the keying member, allows for the connector to be inserted onto the post from any direction.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector for connecting to a terminal post, the electrical connector comprising:

a housing body having a post receiving passage for receiving the terminal post therein;

a contact provided in the post receiving passage, the contact positioned about the circumference of the post receiving passage wherein the contact will make an electrical engagement with a terminal post inserted into the post receiving passage regardless of the orientation of the terminal post with respect to the contact; and a locking release member moveably mounted to the housing body, the locking release member being moveable between a first position and a second position, the locking release member cooperating with a locking spring member, the locking spring member having a locking section which cooperates with a recess of the terminal post when the locking release member is in the first position;

a keying member receiving recess provided in the housing proximate the post receiving passage, the keying member receiving recess is configured to cooperate with a keying member positioned on the post to ensure proper mating of the connector to the post.

2. The electrical connector as recited in claim 1, wherein the housing body has a wire receiving passage which extends from a sidewall to the post receiving passage.

3. The electrical connector as recited in claim 1, wherein the contact is a band which extends about the circumference of the post receiving passage.

4. The electrical connector as recited in claim 3, wherein the band has resilient contact arms which extend into the post receiving passage.

5. The electrical connector as recited in claim 1, wherein a terminal post receiving opening extends through a first end of the connector body, the terminal post receiving opening is in alignment with the post receiving passage, the opening dimensioned to receive a free end of the terminal post therein.

6. The electrical connector as recited in claim 5, wherein the locking release member has a recess which receives the free end of the terminal post, the recess is dimensioned to be larger than the free end of the terminal post to allow the locking release member to move relative to the free end of the terminal post.

7. The electrical connector as recited in claim 5, wherein latching arms are provided on either side of locking release member, each latching arm has a projection which is dimensioned to be received in an opening of the housing body, the projections are movable in the openings as the locking release member is moved between the first position and the second position.

8. The electrical connector as recited in claim 5, wherein the locking spring member has a pair of mounting sections which cooperate with the locking release member, the locking section extends between the mounting sections.

9. The electrical connector as recited in claim 1, wherein locking section which has a radiused locking surface which cooperates with a recess of the terminal post when the locking release member is in the first position.

10. The electrical connector as recited in claim 1, wherein the locking spring member is in a pre-stressed position when the locking release member is in the first position.

11. The electrical connector as recited in claim 10, wherein the locking spring member is in a stressed position when the locking release member is in the second position.

12. An electrical connector system comprising:

a post;

a keying member; and an electrical connector, the electrical connector comprising:

a housing body having a post receiving passage for receiving the terminal post therein;

a contact provided in the post receiving passage, the contact positioned about the circumference of the post receiving passage wherein the contact will make an electrical engagement with a terminal post inserted into the post receiving passage regardless of the orientation of the terminal post with respect to the contact; and a locking release member moveably mounted to the housing body, the locking release member being moveable between a first position and a second position, the locking release member cooperating with a locking spring member, the locking spring member having a locking section which cooperates with a recess of the terminal post when the locking release member is in the first position;

a keying member receiving recess provided in the housing proximate the post receiving passage, the keying member receiving recess is configured to cooperate with the keying member positioned on the post to ensure proper mating of the connector to the post.

13. The electrical connector system as recited in claim 12, wherein the keying member has a first end and a second end, a keying projection extends from the second end in a direction away from the first end, an opening is provided in the keying member, the openings extends through the keying member to allow the posts to be inserted therethrough.

14. The electrical connector system as recited in claim 13, wherein the keying projection extends about, and is spaced from, the circumference of opening.

15. The electrical connector system as recited in claim 12, wherein a terminal post receiving opening extends through a first end of the connector body, the terminal post receiving opening is in alignment with the post receiving passage, the opening dimensioned to receive a free end of the terminal post therein.

16. The electrical connector system as recited in claim 15, wherein the locking release member has a recess which receives the free end of the terminal post, the recess is dimensioned to be larger than the free end of the terminal post to allow the locking release member to move relative to the free end of the terminal post.

17. The electrical connector system as recited in claim 16, wherein latching arms are provided on either side of locking release member, each latching arm has a projection which is dimensioned to be received in an opening of the housing body, the projections are movable in the openings as the locking release member is moved between the first position and the second position.

18. The electrical connector as recited in claim 12, wherein the locking spring member is in a pre-stressed position when the locking release member is in the first position.

19. The electrical connector as recited in claim 12, wherein the locking spring member is in a stressed position when the locking release member is in the second position.

20. An electrical connector for connecting to a terminal post, the electrical connector comprising:

a housing body having a post receiving passage for receiving the terminal post therein;

a contact provided in the post receiving passage, the contact positioned about the circumference of the post receiving passage wherein the contact will make an electrical engagement with a terminal post inserted into the post receiving passage regardless of the orientation of the terminal post with respect to the contact; and a locking release member moveably mounted to the housing body, the locking release member being moveable between a first position and a second position, the locking release member cooperating with a locking spring member, the locking spring member having a locking section which cooperates with a recess of the terminal post when the locking release member is in the first position.

* * * * *